US006632773B1

(12) United States Patent
Kranz et al.

(10) Patent No.: US 6,632,773 B1
(45) Date of Patent: Oct. 14, 2003

(54) HEAT-SENSITIVE RECORDING MATERIALS AND METHOD FOR AUTHENTICITY CHECKING

(75) Inventors: Erich Kranz, Flensburg (DE); Karsten Süssenbach, Flensburg (DE); Gerhard Stork, Flensburg (DE); Michael Reimann, Flensburg (DE); Wolfgang Wagner, Flensburg (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 0 days.

(21) Appl. No.: 09/554,788

(22) PCT Filed: Aug. 19, 1999

(86) PCT No.: PCT/EP99/06060

§ 371 (c)(1),
(2), (4) Date: May 19, 2000

(87) PCT Pub. No.: WO00/16986

PCT Pub. Date: Mar. 30, 2000

(30) Foreign Application Priority Data

Sep. 19, 1998 (DE) ..... 198 42 867
Sep. 19, 1998 (DE) ..... 198 42 866

(51) Int. Cl.[7] ..... B41M 5/30
(52) U.S. Cl. ..... 503/201; 503/204; 503/206
(58) Field of Search ..... 503/201, 206, 503/204

(56) References Cited

U.S. PATENT DOCUMENTS

| | | | | |
|---|---|---|---|---|
| 4,136,229 | A | 1/1979 | Godet et al. | 428/537 |
| 5,308,824 | A | 5/1994 | Matsushita et al. | 503/226 |

FOREIGN PATENT DOCUMENTS

| | | | |
|---|---|---|---|
| AT | 370 53 | | 1/1986 |
| DE | 25 18871 | A1 | 11/1975 |
| DE | 27 47 349 | C2 | 5/1979 |
| DE | 195 -01 289 | A1 | 7/1996 |
| DE | 296 17 106 | U1 | 4/1997 |
| EP | 0 072 481 | B1 | 2/1983 |
| EP | 0 327 788 | | 8/1989 |
| EP | 0 844 097 | A1 | 5/1998 |

OTHER PUBLICATIONS

Römpps Chemical Dictionary, vol. 1, p. 347, 1979.

"Ullmanns Encyklopädie der technischen Chemie", Milchsäure bis Petrolkoks.

"Ullmanns Encyklopädie der technischen Chemie", Antimon und Antimon– Verbindungen bis Brot und andere Backwaren, 3 pp, published by Gerlag Chemie GmbH, 1974.

Article "Lehrbuch der Textilchemie einschl. Der textilchemischen Technologie" by Dr. Hermann Rath, published by Springer–Verlag 1963.

*Primary Examiner*—B. Hamilton Hess
(74) *Attorney, Agent, or Firm*—Cohen, Pontani, Lieberman & Pavane

(57) ABSTRACT

A method of checking the authenticity of a heat-sensitive recording material having a carrier paper with a recording layer which is arranged on one face and which contains colorant formers and organic colorant acceptors that react with one another when heated; and a security feature provided as a water-soluble dye which fluoresces under UV radiation, the dye being applied without binder in a pattern, invisible under daylight, to a surface of a face of the carrier paper opposite the face provided with the recording layer, so that the entire surface has the pattern, the water-soluble dye being applied at a mass per unit area between 0.01 and 40 $mg/m^2$, the method comprising the step of wetting the surface of the layer opposite the recording layer with an alkaline substance.

14 Claims, No Drawings

HEAT-SENSITIVE RECORDING MATERIALS AND METHOD FOR AUTHENTICITY CHECKING

PRIORITY CLAIM

This is a U.S. national stage of application No. PCT/EP99/06060, filed on Aug. 19, 1999. Priority is claimed on that application and on the following applications: Country: Germany, Application No.: 198 42 866.9, Filed: Sep. 19, 1998; Country: Germany, Application No.: 198 42 867.7, Filed: Sep. 19, 1998.

BACKGROUND OF THE INVENTION

1. Field of the Invention

The invention pertains to heat-sensitive recording materials with security features, having a carrier paper with a recording layer which is arranged on one face and which contains colorant formers and organic colorant acceptors reacting with one another under the action of heat. In addition, the invention pertains to methods of checking the authenticity of the recording materials according to the invention.

2. Discussion of the Prior Art

Heat-sensitive recording materials have been known for a long time. These materials are predominantly used for recording fax messages which are sent via public telephone networks—the so-called telefax method. Additional fields of use for heat-sensitive recording materials are gradually gaining in significance as a result of their use as credit transfer forms or checks, diplomas, certificates, instruction leaflets for pharmaceutical products, receipts for games of chance of all types, postage stamps, sales slips, parking tickets from automatic parking machines and entry and travel tickets.

Various solutions have already been proposed in the past for avoiding or detecting counterfeits. In addition to the use of watermarks, in particular the use of fibers which fluoresce under ultraviolet radiation has been proposed, a small quantity of said fibers being mixed with the paper fibrous stock before sheet formation. Corresponding proposals for papers which should not be included in the field of heat-sensitive recording materials are found in AT E 37053 B and, according to DE 195 01 289 A 1, for a heat-sensitive recording paper. The incorporation of fluorescent fibers into the paper fibrous stock is disadvantageous from a production point of view, however, for example as a result of prolonged cleaning down times on the paper machine. At the same time, the waste from paper manufactured in this way can be recycled only to a very restricted extent, because of the synthetic fibers, which are obvious to the naked-eye.

DE 25 18 871 A 1 discloses, as a security feature for coated papers, the application of two substances of the same type, which contain at least one colorant former as an azo compound and at least one dye or a pigment in or to the carrier paper. In order to check authenticity, a reagent is applied to the paper by means of a stamp, felt pen or roll device, the substance in or on the carrier paper reacting together with the reagent in the form of a colorant formation. According to this reference, the security feature described in this way can be combined with other security features, such as watermarks.

Security features of the type of added dyes in the paper stock or on the paper surface are also disclosed in DE 296 17 106 U 1, with regard to the addition of pigments based on anthraquinone, and in EP 0 072 481 B 1 with regard to an admixture of 2-(4'-amino-3'-sulfophenyl)-6-methylbenzothiazole-7-sulfonic acid or the salts thereof. These last-mentioned proposals do not all relate to the field of heat-sensitive recording materials. The use of azine dye as a security feature is not disclosed.

DE 27 47 349 C 2 discloses, as the sole security feature for anti-counterfeit papers which are intended to be used in particular as payment instructions to be filled out by hand, the use of pyrenesulfonic acids or their metal salts, which are either added to the paper stock or with which the paper web is impregnated, which results in the complete coloring of the paper surface.

EP 0 844 097 A 1 discloses a heat-sensitive recording material in which, as a first security feature, at some locations a latent image is printed onto the back by means of a security ink containing a fluorescent reagent. In order to form a second security feature in the form of a watertight image on the back of the heat-sensitive recording material, the security ink contains an agent which repels water. The security ink containing the fluorescent reagent that is used as the pigment or dye and the water-repellent agent is contained or dispersed in an aqueous carrier which, in addition to these components, also contains binders, such as thermoplastic resins, which are intended to improve the fastness of the image. The drawback with this proposal is the costly manufacture by means of printing technology and the fact that the arrangement of preprint by means of the conventional printing process is made more difficult by the water-repellent character of the security ink.

SUMMARY OF THE DESCRIPTION OF THE INVENTION

The present invention, then, wishes to provide heat-sensitive recording materials in which, with the aid of simple equipment which is available anywhere, a number of possibilities of examining the authenticity of the paper employed are possible. A further object of the invention is the development of a security feature which permits checking of the authenticity of the paper employed far more clearly than a preparation over the entire area. At the same time, the invention wishes to provide effective protection against attempts at counterfeiting. Another object of the invention, during the manufacture of a heat-sensitive recording material, is to dispense with those components which are to be added to the paper stock and which, like fluorescent fibers for example, can result in the problems mentioned at the beginning within the production process. Finally, a further important object is that, if required, so-called preprints can be applied without difficulty to the back of the heat-sensitive recording materials without interference in the printing process having to be feared as a result of components, such as binders or hydrophobicizing agents, present in the preparation applied to the back.

In order to achieve the object, according to a first and particularly simple embodiment, the invention provides a heat-sensitive recording material with a security feature which comprises a carrier paper with a recording layer which is arranged on one face and which contains colorant formers and organic colorant acceptors reacting with one another under the action of heat. The heat-sensitive recording material is defined in that, as the security feature, a water-soluble dye which fluoresces under UV radiation is applied without binder in a regular or irregular pattern, invisible under daylight, to the entire surface of the face opposite the face provided with a recording layer, that is to say the back, in such a way that the entire surface has the pattern.

As opposed to the previously known embodiments of security papers, in which fluorescence which is effective over the entire area was achieved either by putting appropriate dyes into the fibrous stock or by means of a preparation, the heat-sensitive recording paper of the present invention, as a result of the type of its patterning, offers a security component which goes beyond the security feature to be detected within the context of an authenticity check using an alkaline substance to be applied, and cannot readily be imitated.

An irregular pattern in the sense of the present invention preferably corresponds to a fine-grained structure which, put another way, can be described as a sprinkling, while a regular pattern preferably corresponds to a striped structure. In the acid or neutral pH range, the back, to which dye is applied, appears to be slightly colored when viewed by the naked eye under daylight.

The advantage of the water-soluble dye, applied without binder, according to the present embodiment is that the provision of preprints does not come up against the problems such as are known in the coatings known from the prior art which contain binders or hydrophobicizing agents.

In the present description, preprints are to be understood as imprints which are applied by means of flexographic or offset printing, in particular dry or waterless offset printing, for example, such as form inscriptions, in which the fields in the form are filled out by means of a thermal printer during subsequent proper use.

With regard to the aforementioned embodiments of the invention, dyes which have been shown to be particularly suitable are those which, in the context of a security check, lead to a coloration which fluoresces even under daylight, in particular even a persistent coloration, as a result of the application of an alkaline substance to the back of the recording material according to the invention. Here, particularly preferred dye classes to be mentioned are dyes based on pyrene sulfonate.

The water-soluble dye which fluoresces under UV radiation is preferably applied at a mass per unit area of 0.01 to 40 mg/m$^2$, quite particularly preferably at a mass per unit area of 0.05 to 7.5 mg/m$^2$, to the face opposite the face provided with a recording layer.

As a further and particularly counterfeit-proof embodiment, the invention provides a heat-sensitive recording material with security features which comprises a carrier paper with a recording layer which is arranged on one face and which contains colorant formers and organic colorant acceptors reacting with one another under the action of heat. As the first security feature, a water-insoluble azine dye which is invisible to the naked eye is incorporated in the carrier paper and, when the face of the recording material opposite the recording layer has its surface wetted with an organic solvent or an acid, effects a striking coloration. As the second security feature, a layer is applied to the face of the carrier paper opposite the recording layer, that is to say the back, the layer having a dye which is based on pyrene-sulfonate and is only barely visible in the acid or neutral pH range. When in contact with an alkaline substance the dye based on pyrene sulfonate enters into a coloring reaction which leads to a coloration which fluoresces and persists under daylight.

In the above-described embodiment of the invention, the pyrene sulfonate dye, when the avoidance of print stability problems is concerned, can be applied without a binder, but a common application with a binder, for example by means of a starch coating, is also possible.

The azine dye is preferably incorporated in the carrier paper in an amount from 0.005 to 0.1% by weight, quite particularly preferably in an amount from 0.01 to 0.03% by weight.

The azine dyes in the sense of the present invention are to be understood to include the dyes characterized by the pyrazine ring (paradiazine ring) with attached aromatic nuclei.

With regard to the embodiments of the invention which are described as particularly counterfeit-proof both in the previous paragraphs and in the following paragraph, it is further preferred for the mass per unit area of the dye in the layer which is applied to the face of the carrier paper opposite the recording layer to be between 0.01 and 40 mg/m$^2$ and, particularly preferably, between 0.05 and 7.5 mg/m$^2$.

Quite particularly preferred as the most counterfeit-proof embodiment, the invention provides a heat-sensitive recording material with security features which comprises a carrier paper with a recording layer which is arranged on one face and which contains colorant formers and organic colorant acceptors reacting with one another under the action of heat. As the first security feature, a water-insoluble azine dye which is invisible to the naked eye is incorporated in the carrier paper and, when the face of the recording material opposite the recording layer has its surface wetted with an organic-solvent or an acid, effects a striking coloration. As the second security feature, a water-soluble dye which fluoresces under UV radiation is applied without binder in a regular or irregular pattern, invisible under daylight, to the surface of the face opposite the face provided with a recording layer, in such a way that the entire surface has the pattern.

Here, too, the advantage of the water-soluble dye applied without a binder is that the provision of preprints does not come up against the printability problems previously explained.

With regard to the recording papers according to the invention, which have a water-soluble dye which fluoresces under UV radiation on the face opposite the face provided for recording, it is possible to carry out a first authenticity check in that the side opposite the side provided for recording is viewed under UV radiation, it being possible to see the pattern which is not visible under daylight. If, in the recording paper according to the invention, the dye based on pyrene sulfonate is applied in a-regular or irregular pattern to the face opposite the face provided for recording, this pattern can be detected under UV radiation.

A particularly preferred method of checking the authenticity of all the recording papers according to the invention provides for wetting the surface of the face opposite the side provided for recording, in particular using a test pen or a comparably simple device, with an alkaline substance, as a result of which a fluorescent persistent coloration which is visible under daylight is produced. Since alkaline substances are contained in the conventional ink removing pens, even attempts at counterfeiting can be detected in this way.

A further method of checking authenticity with regard to the recording papers provides for the surface of the layer opposite the recording layer to be wetted with the smallest possible quantity of a mixture of a primary alcohol, a secondary alcohol and an acid, by means of a test pen, sponge, stamp or a comparable simple technical device. A striking coloration of the wetted surface permits conclusions to be drawn as to the authenticity of the heat-sensitive recording material examined, it being necessary to avoid as far as possible a color reaction in the recording layer which corresponds to the color reaction of the azine dye with the organic solvent or the acid.

The statements made in the description and patent claims relating to the mass per unit area and to percent by weight refer to the absolute dry weight, that is to say they are proportions of the absolute dry weight.

The carrier papers used are preferably wood-free papers with any desired mass per unit area. The recording layer may be applied to a precoat. A layer applied to the face of the carrier paper opposite the recording layer is preferably composed of a starch.

EXAMPLES

The following examples explain the invention.

Example 1

A commercially available wood-free paper, which is provided for the manufacture of security documents, such as travel passes or receipt documents, and has a mass per unit area of 65 g/m$^2$, is provided on the back with a starch preparation and on the front with an intermediate layer which is provided for the application of the heat-sensitive-recording layer and essentially comprises oil-absorbing pigment and binder. An irregular pattern in the manner of a fine-grained structure is then applied to the dried starch preparation by means of an aqueous solution of a dye based on pyrene sulfonate. The mass per unit area of the dye applied is 2.8 mg/m$^2$. Under UV radiation at 254 nm, the pattern shows a greenish color, under UV radiation at 360 nm, the pattern can be seen in a bluish color. Under daylight, the back of the papers has a coloration which is barely visible with the naked eye.

Example 2

Within the context of a production trial, azine dye is added in a quantity of 0.015% by weight commercial product, based on the absolute dry weight of carrier paper, to the a carrier paper to be manufactured on a Fourdrinier paper machine at a mass per unit area of 80 g/m$^2$.

The starch coating to be applied to the back of the carrier paper contains a pyrene sulfonate, which is present in the starch coating on the back at a mass per unit area of 7 mg/m$^2$. A heat-sensitive recording layer is applied to a pigment precoat applied to the front face.

Example 3

A carrier paper provided for commercially available ticket paper and which corresponds to the above-described carrier paper but has a mass per unit area of 67 g/m$^2$ has a starch coating applied to the back and a pigment precoat applied to the front. Firstly, a heat-sensitive recording layer is applied to the pigment precoat and then dried. Finally, a coating with a pyrene sulfonate is applied at a mass per unit area of 2.9 mg/m$^2$ to the starch coating applied to the back.

Example 4

For the purpose of checking the authenticity of the recording materials of Examples 2 and 3, a felt pen is produced which, as test substance, contains a mixture of 70% lactic acid, 15% ethanol and 15% isopropyl alcohol. With the aid of this test substance it is possible to effect a coloration as a result of solubilizing the azine dye by wetting the surface of the face of the recording material opposite the recording layer. In this case, there is no corresponding color reaction of the recording layer. The latter would be started were a solvent to be used, in exactly the same way as if there were an excessive application of the test substance.

By using a commercially available ink killer, an alkaline substance is subsequently applied to the face of the recording material opposite the recording layer. The reaction of the dyes based on pyrene sulfonate with the alkaline substance leads instantaneously to a persistent coloration which fluoresces under daylight.

What is claimed is:

1. A heat-sensitive recording material with security feature, comprising: a carrier paper with a recording layer arranged on one face and which contains colorant formers and organic colorant acceptors that react with one another when heated; and a security feature provided as a water-soluble dye which fluoresces under UV radiation, the dye being applied without binder in a pattern, invisible under daylight, to a surface of a face of the carrier paper opposite the face provided with the recording layer, so that the entire surface has the pattern, the water-soluble dye being applied at a mass per unit area between 0.01 and 40 mg/m$^2$.

2. A heat-sensitive recording material as defined in claim 1, wherein the dye is applied in a regular pattern.

3. A heat-sensitive recording material as defined in claim 1, wherein the dye is applied in an irregular pattern.

4. A heat-sensitive recording material as defined in claim 1, wherein the water-soluble dye, when in contact with an alkaline substance, forms a coloration which fluoresces under daylight.

5. A heat-sensitive recording material as defined in claim 1, wherein the water-soluble dye is applied at a mass per unit area between 0.05 and 7.5 mg/m$^2$.

6. The heat-sensitive recording material as defined in claim 1, wherein the water-soluble dye is a dye based on pyrene sulfonate.

7. The heat-sensitive recording material as defined in claim 6, and further comprising an additional security feature, the additional security feature being a water-soluble azine dye that is invisible to the naked eye that is incorporated in the carrier paper so that, when the face of the recording material opposite the recording layer has its surface wetted with one of an organic solvent and an acid a striking coloration is effected; and a further security feature applied as a layer to the face of the carrier paper opposite the recording paper, the security layer having a dye which is based on pyrene sulfonate and is only ;barely visible in one of an acid and neutral pH range so that when in contact with an alkaline substance the dye enters into a coloring reaction which leads to a coloration that fluoresces and persists under daylight.

8. A heat-sensitive recording material as defined in claim 7, wherein azine dye in an amount from 0.005 to 0.1% by weight is incorporated in the carrier paper.

9. A heat-sensitive recording material as defined in claims 8, wherein azine dye in an amount from 0.01 to 0.03% by weight is incorporated in the carrier paper.

10. A heat-sensitive recording material as defined in claim 7, wherein the dye based on pyrene sulfonate is applied at a mass per unit area between 0.01 and 40 mg/m$^2$.

11. A heat-sensitive recording material as defined in claim 10, wherein the dye based on pyrene sulfonate is applied at a mass per unit area between 0.05 and 7.5 mg/m$^2$.

12. A heat-sensitive recording material as defined in claim 1, and further comprising an additional security feature which is a water-insoluble azine dye, that is invisible to the naked eye, incorporated in the carrier paper so that when a face of the recording material opposite the recording layer has its surface wetted with one of an organic solvent and an acid a striking coloration is effected.

13. A method of checking the authenticity of a heat-sensitive recording material having a carrier paper with a recording layer which is arranged on one face and which contains colorant formers and organic colorant acceptors that react with one another when heated; and a security feature provided as a water-soluble dye which fluoresces under UV radiation, the dye being applied without binder in a pattern, invisible under daylight, to a surface of a face of the carrier paper opposite the face provided with the recording layer, so that the entire surface has the pattern, the water-soluble dye being applied at a mass per unit area between 0.01 and 40 $mg/m^2$, the method comprising the step of wetting the surface of the layer opposite the recording layer with an alkaline substance.

14. A method of checking the authenticity of a heat-sensitive recording material as defined in claim 13, including wetting the surface with a test pen.

* * * * *